US005994850A

United States Patent [19]

Seddon et al.

[11] Patent Number: 5,994,850

[45] **Date of Patent: *Nov. 30, 1999**

[54] SWITCHING ARRANGEMENTS WHEREIN A CYLINDRICAL TRIGGER ELECTRODE IS ARRANGED AROUND A GAP BETWEEN AN ANODE AND CATHODE FOR ESTABLISHING A DISCHARGE THEREBETWEEN

[75] Inventors: Richard John Seddon, Dunston; Kenneth George Cook, Northwood, both of United Kingdom

[73] Assignee: EEV Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/704,860

[22] Filed: Aug. 28, 1996

[30] Foreign Application Priority Data

| | | | |
|---|---|---|---|
| Sep. 8, 1995 | [GB] | United Kingdom | 9518415 |
| Oct. 27, 1995 | [GB] | United Kingdom | 9522085 |
| Aug. 6, 1996 | [GB] | United Kingdom | 9616542 |

[51] Int. Cl.[6] ..... H01J 17/30

[52] U.S. Cl. ..... 315/335; 315/330; 315/326; 313/602; 313/603; 313/609; 313/162; 218/132; 218/140; 218/118; 218/123

[58] Field of Search ..... 313/602, 609, 313/603, 162; 218/132, 140, 141, 118, 123; 315/330, 335, 326

[56] References Cited

U.S. PATENT DOCUMENTS

| | | | |
|---|---|---|---|
| 2,103,159 | 12/1937 | Kingdon | 313/609 |
| 3,328,632 | 6/1967 | Robinson | 313/602 |
| 4,198,590 | 4/1980 | Harris | 315/335 |

FOREIGN PATENT DOCUMENTS

| | | | |
|---|---|---|---|
| 712698 | 6/1965 | Canada | 218/132 |
| 0 346 957 | 4/1931 | United Kingdom . | |
| 715284 | 9/1954 | United Kingdom . | |
| 0 592 266 | 3/1955 | United Kingdom . | |
| 725685 | 3/1955 | United Kingdom . | |
| 1 126 661 | 9/1968 | United Kingdom . | |
| 1 190 957 | 5/1970 | United Kingdom . | |
| 1 205 763 | 9/1970 | United Kingdom . | |
| 1 439 775 | 6/1976 | United Kingdom . | |
| 1 471 938 | 4/1977 | United Kingdom . | |
| 2 176 934 | 1/1987 | United Kingdom . | |

*Primary Examiner*—Arnold Kinkead
*Attorney, Agent, or Firm*—Venable; Robert J. Frank; Robert Kinberg

[57] ABSTRACT

A switch for switching large currents and large charges includes an anode separated from a cathode with a cylindrical trigger electrode located around the anode and the gap. The cathode is of a metal such as zinc, cadmium, tin or magnesium. During operation, a suitable potential applied to the trigger electrode causes a main discharge to occur between the anode and the cathode.

18 Claims, 1 Drawing Sheet

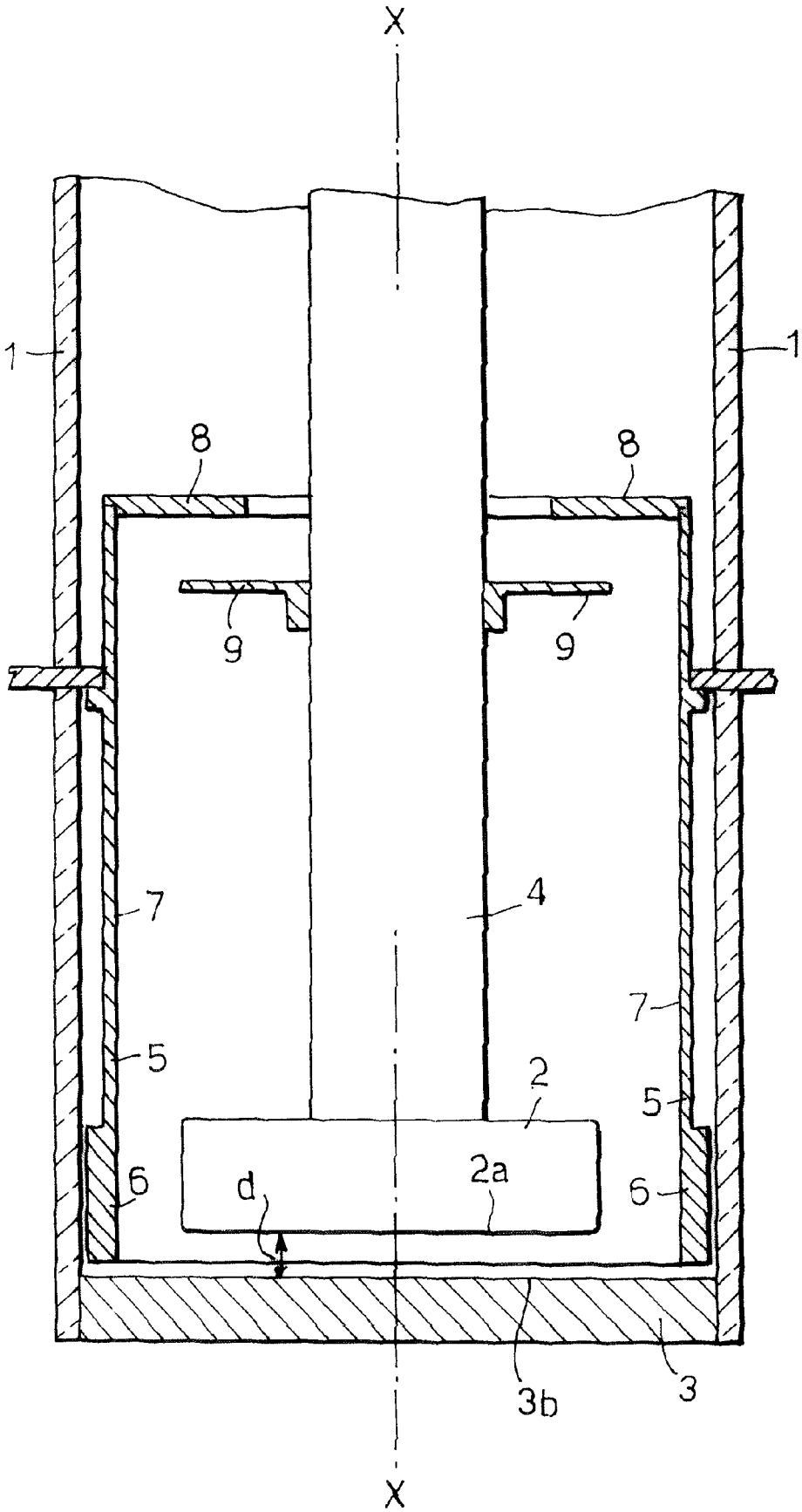
X
1
1
8
8
9
9
7
4
7
5
2
5
6
d
2a
6
3b
3
X

SWITCHING ARRANGEMENTS WHEREIN A CYLINDRICAL TRIGGER ELECTRODE IS ARRANGED AROUND A GAP BETWEEN AN ANODE AND CATHODE FOR ESTABLISHING A DISCHARGE THEREBETWEEN

FIELD OF THE INVENTION

This invention relates to switch arrangements and more particularly to arrangements capable of high Coulomb, high current switching.

BACKGROUND OF THE INVENTION

An ignitron is a known device used for switching large currents in which a pool of liquid mercury acts as a cathode. An ignitor is used to establish an initial discharge between the mercury cathode and the ignitor. The initial discharge then enables the main arc between the anode and the mercury cathode to be struck and hence allow conduction through the switch.

The present invention arose from considering a switch arrangement capable of conducting large amounts of charge and high currents without requiring the use of mercury.

SUMMARY OF THE INVENTION

According to a first aspect of the invention, a switch arrangement comprises an evacuated envelope containing a cathode and an anode separated by a gap and a substantially cylindrical trigger electrode arranged about the gap, the arrangement being such that during use, a potential difference is maintained between the cathode and anode and on application of a trigger voltage to the trigger electrode, a main discharge is established between the anode and cathode.

By employing the invention, it is possible to switch large currents and charges without the need to use mercury as a cathode. This has the advantage that the switch does not need to be kept in a particular orientation for it to work correctly because the cathode material is solid under normal operating conditions, unlike mercury, and also less toxic material may be chosen as a cathode. It is preferred that the cathode material is a metal element of alloy which is easily vaporisable to enable a metallic vapour to be readily produced when the trigger electrode is used to begin the conduction process, the vapour taking part in the conduction mechanism during operation. Suitable metals for the cathode include zinc, cadmium, tin and magnesium. Use of a cathode material which is easily vaporisable quickly produces a plasma which reduces the arc voltage in the device and hence reduces electrode dissipation and damage.

As the switch arrangement is a vacuum device it operates to the left hand side of the Paschen minimum, Paschen's law relating breakdown voltage to pressure and electrode spacing. In this regime smaller electrode spacing results in higher breakdown voltages.

Preferably, the trigger electrode has a thick wall in the region of the gas and a thinner wall which supports the thick wall. This encourages the main discharge to be formed between the cathode and anode after the initial trigger arc between the trigger electrode and cathode initiates conduction within the switch. The resistance offered by the thin wall ensures that the preferred route for the main discharge is through the anode. In one preferred embodiment, the trigger electrode also supports a baffle which ensures that vapour produced during operation of the switch is directed back towards the cathode/anode region. The configuration of the cathode and anode and the surrounding trigger electrode tends to retain cathode material released from the cathode surface during operation within the active region of the device. Some deposition may occur on the anode which may be beneficial during reverse current conditions. Cathode material may coat all the electrodes in the switch. This layer on the anode and cathode surfaces gives high electron emission and also by its vaporisation leads to cooling of the anode and cathode and hence to less melting damage. The anode is in one preferred embodiment supported by an anode stem which supports a baffle to further ensure that cathode material vapour is kept in the required part of the switch.

By using the invention, it is possible to switch currents of the region of 600 kA repeatedly. The voltage hold off between the anode and cathode in one preferred embodiment is of the order of tens of kilovolts.

In a preferred embodiment, the trigger electrode is closely spaced from the inner surface of the vacuum envelope, which preferably is of ceramic. The close clearance of the trigger electrode to cathode material deposited on the envelope surface produces a displacement current when the trigger electrode is pulse triggered with respect to the cathode. This displacement current, flowing in the film of deposited material at cathode potential, produces emission arc spots which vaporise readily, and give a low trigger voltage.

According to a second aspect of the invention a switch arrangement comprises an evacuated envelope containing a cathode and an anode separated by a gap and a trigger electrode arranged to trigger a discharge between the cathode and anode on application of a suitable voltage, wherein the cathode is of a metallic material which is easily vaporisable and which is solid at room temperature.

By "easily vaporisable" it is meant that under normal operating conditions of a switch arrangement in accordance with the invention cathode material vaporises and takes part in the conduction mechanism.

BRIEF DESCRIPTION OF THE DRAWING

One way in which the invention may be performed is now described by way of example with reference to the accompanying drawing in which the sole FIGURE schematically illustrates in longitudinal cross-section a switch in accordance with the invention.

DESCRIPTION OF A PREFERRED EMBODIMENT

With reference to the FIGURE, a high Coulomb high current switch includes an evacuated cylindrical ceramic envelope 1 within which is contained an anode 2 and a cathode 3 having flat facing surfaces 2*a* and 3*b* defining a gap d between them. In this embodiment, the cathode is of zinc. The anode 2 is supported by a an anode stem 4, the anode 2 and cathode 3 being coaxially aligned along the axis X—X of the cylindrical envelope 1. A cylindrical trigger electrode 5 is also located coaxially about the axis X—X and has a thick end portion 6 located about the anode and surrounding the gap between the facing surfaces of the anode 2 and cathode 3. Further, the trigger 5 has a thin cylindrical wall portion 7 which extends parallel to the anode stem 4 and carries an inwardly directed baffle 8 at its upper end as shown. The anode stem 4 also carries a baffle 9 which overlaps with the baffle 8 in the longitudinal axial direction to present a convoluted path to vapour formed during operation of the switch. The trigger electrode 5 is located close to the interior surface of the envelope 1 so as to shield the envelope surface from condensation of vapour produced during operation of the switch.

During operation, a voltage of the order of 40 kV is held off between the anode and cathode. When it is wished to trigger the switch into conduction, a suitable voltage is applied to the trigger electrode 5 to cause an arc to be struck between the cathode 3 and trigger electrode 5. This results in metal vapour being evaporated from the cathode 3 and causes a main discharge to be initiated between the anode 2 and the cathode 3 to give conduction through the switch. The configuration of the anode 2, cathode 3 and trigger electrode 5 are such that most of the metal vapour from the cathode 3 is retained within the gap between the anode and cathode, being deposited on these electrodes after the switch ceases conduction and the temperature drops within the device. Some zinc is also deposited on the trigger electrode 5 and on the ceramic wall adjacent to it.

The cathode is preferably of zinc but other suitable metals include cadmium, tin and magnesium.

The triggering electrode 5 is annular and the arrangement of the electrodes is substantially symmetrical about the axis X—X. This ensures that the initial arc is struck at different locations on the cathode surface on subsequent operations. The thin wall 7 supports the thicker free end 6 of the trigger electrode 5 such that once the initial discharge is struck, the resulting main discharge will pass through the anode 2 and not upwardly along the trigger electrode.

We claim:

1. A switch arrangement comprising:

an evacuated envelope;

a cathode and an anode separated by a gap and contained within said envelope;

a substantially cylindrical trigger electrode arranged around and completely external to said gap; and means for applying a trigger voltage to said trigger electrode when switching is desired whereby a main discharge is established between said anode and said cathode.

2. An arrangement as claimed in claim 1 wherein said trigger electrode comprises a wall of a thickness which is greater around said gap than in a region remote from said gap.

3. An arrangement as claimed in claim 1 wherein said trigger electrode supports a baffle.

4. An arrangement as claimed in claim 1 wherein said anode is supported by an anode stem which carries a baffle.

5. An arrangement as claimed in claim 1 wherein said envelope is substantially cylindrical and said trigger electrode is located closely adjacent said envelope to shield its interior surface.

6. An arrangement as claimed in claim 1 wherein said cathode and anode are capable of switching currents of up to 600 kA.

7. An arrangement as claimed in claim 1 wherein said cathode is of an easily vaporisable metal or metallic alloy.

8. An arrangement as claimed in claim 1 wherein said cathode is at least one of zinc, cadmium, tin or magnesium.

9. An arrangement as claimed in claim 1 wherein said envelope is of ceramic.

10. A switch arrangement comprising:

an evacuated envelope;

a cathode and an anode separated by a gap and contained within said envelope; and a trigger electrode arranged to trigger, when switching is desired, a discharge between said cathode and anode by application of a trigger voltage to said trigger electrode, wherein substantially all of said cathode is composed of an easily vaporizable metal or metallic alloy which produces a plasma that reduces an arc voltage within said envelope and which is solid at room temperature.

11. An arrangement as claimed in claim 10 wherein said cathode is at least one of zinc, cadmium, tin or magnesium.

12. An arrangement as claimed in claim 10 and capable of switching currents of up to 600 kA.

13. A switch for selectively switching an electric current comprising:

an evacuated envelope having a longitudinal axis;

a cathode and an anode separated by a gap extending in the direction of said longitudinal axis, said cathode and anode being contained within said envelope;

an anode stem supporting said anode and extending in the direction of said longitudinal axis; and a substantially cylindrical trigger electrode arranged around said anode stem, said anode and said gap extending in the direction of said longitudinal axis, the portion of said trigger electrode arranged around said gap being thicker than the portion thereof arranged around said anode stem, a discharge being established between said anode and cathode when a trigger voltage is selectively applied to said trigger electrode.

14. A switch as claimed in claim 13 wherein said anode stem and trigger electrode are provided with baffles spaced along said longitudinal axis, said baffles presenting a convoluted path to vapor formed during operation of the switch.

15. A switch as claimed in claim 13 wherein said cathode is composed of an easily vaporizable material.

16. A switch as claimed in claim 15 wherein the easily vaporizable material comprising said cathode is selected from the group consisting of at least one of zinc, cadmium, tin and magnesium.

17. A switch as claimed in claim 14 wherein said cathode is composed of an easily vaporizable material.

18. A switch as claimed in claim 17 wherein the easily vaporizable material comprising said cathode is selected from the group consisting of at least one of zinc, cadmium, tin and magnesium.

* * * * *